US011388969B2

(12) United States Patent
Mendy

(10) Patent No.: US 11,388,969 B2
(45) Date of Patent: Jul. 19, 2022

(54) RING STORAGE APPARATUS

(71) Applicant: Christine Mendy, Alameda, CA (US)

(72) Inventor: Christine Mendy, Alameda, CA (US)

( * ) Notice: Subject to any disclaimer, the term of this patent is extended or adjusted under 35 U.S.C. 154(b) by 127 days.

(21) Appl. No.: 16/768,261

(22) PCT Filed: Nov. 28, 2018

(86) PCT No.: PCT/US2018/062858
§ 371 (c)(1),
(2) Date: May 29, 2020

(87) PCT Pub. No.: WO2019/108657
PCT Pub. Date: Jun. 6, 2019

(65) Prior Publication Data

US 2020/0367623 A1 Nov. 26, 2020

Related U.S. Application Data

(60) Provisional application No. 62/591,372, filed on Nov. 28, 2017.

(51) Int. Cl.
*A45C 11/16* (2006.01)
*A45F 5/02* (2006.01)

(52) U.S. Cl.
CPC ..... *A45C 11/16* (2013.01); *A45F 5/021* (2013.01)

(58) Field of Classification Search
CPC ..... A45C 11/16; A45F 5/021; A45F 13/02; B65D 25/102; B65D 73/0071
USPC ..... 224/242, 236, 245, 246; 206/292–296
See application file for complete search history.

(56) References Cited

U.S. PATENT DOCUMENTS 1,486,629 A * 3/1924 Buchsbaum ..... A45C 11/16 206/559
3,900,060 A * 8/1975 Shammas ..... A45C 11/16 229/87.01
5,219,071 A * 6/1993 Knapp ..... B65D 75/14 229/87.01
5,779,033 A * 7/1998 Roegner ..... A45C 7/0095 206/6.1
6,123,195 A * 9/2000 Kyle ..... B65D 25/102 206/478
6,430,783 B1 * 8/2002 Benoit ..... B65D 63/1063 24/16 PB
6,622,346 B2 * 9/2003 Graham ..... B65D 63/1018 24/30.5 R
10,099,831 B2 * 10/2018 Egli ..... A45C 7/0077

* cited by examiner

*Primary Examiner* — Adam J Waggenspack
(74) *Attorney, Agent, or Firm* — Dergosits & Noah LLP

(57) ABSTRACT

An apparatus for temporary storage of one or more rings or other valuable items.

6 Claims, 12 Drawing Sheets

FIG. 4
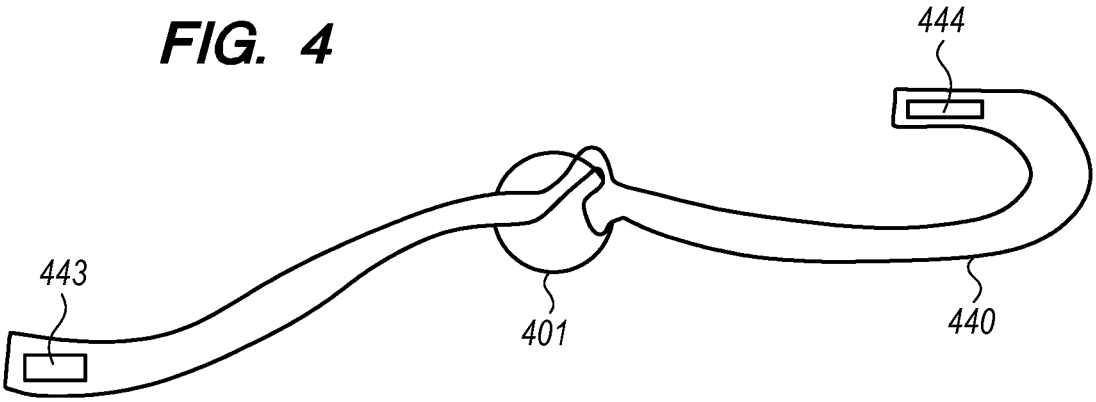
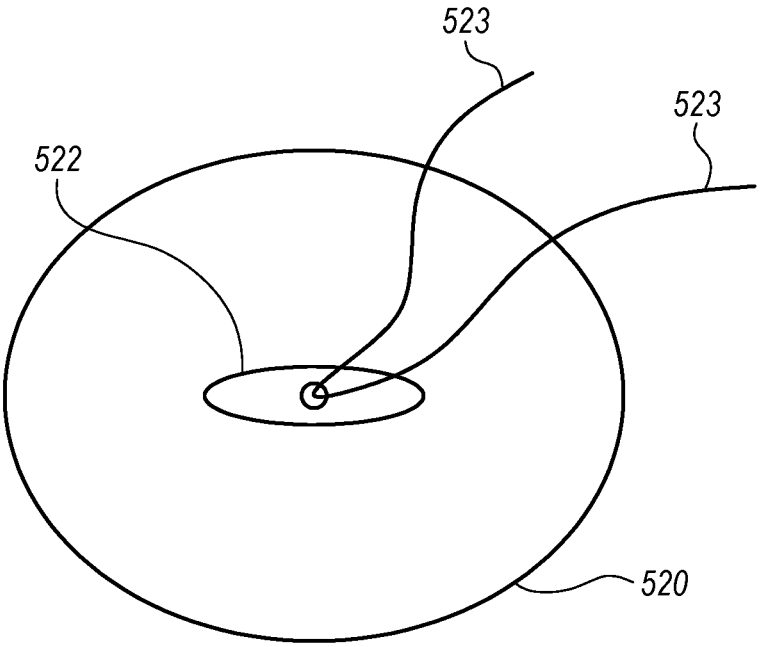
FIG. 5

RING STORAGE APPARATUS

BACKGROUND

This disclosure relates generally to storage of valuables, and more particularly, to a ring storage apparatus that is suitable for quick utilization for temporary storage of a ring or other valuable item(s).

For both safety and health reasons, the wearing of jewelry can become problematic for some workers in a moments' notice. For example, any kind of jewelry is a potentially a bacteria catching item, in particular finger rings, and thus, a health care professional called into a sterile environment should remove their jewelry before scrubbing in for a procedure. Thus, there is a need for at least temporary storage of the jewelry. Some typical solutions include leaving the jewelry in their locker, placing the jewelry in their pocket, tying or pinning the jewelry to their scrubs, or pinning the jewelry to their badge or bra. However, each of these solutions has its own problems, and there is a need for a better solution.

BRIEF DESCRIPTION OF THE DRAWINGS

FIG. 4 is an alternative embodiment of a temporary ring storage apparatus.

FIG. 5 is an alternative embodiment of a temporary ring storage apparatus.

DETAILED DESCRIPTION

This disclosure illustrates and describes several embodiments of an apparatus for temporary storage of a user's ring or other small pieces of jewelry or valuables. In some embodiments, a storage pouch provides a small interior volume to contain the jewelry, and the storage pouch is secured to the user with a strap. In other embodiments, the storage pouch includes a self-adhering element, such as an adhesive strip or adhesive gel, that allows the pouch to be secured directly to the user. In yet other embodiments, the storage pouch includes fastening elements, such as hook and loop fasteners, that allow the pouch to be folded over a strap, such as a bra strap or belt, and adhere to itself. In other embodiments, the ring storage apparatus is not a pouch, but a flat piece of fabric having a flap affixed at one end to the fabric and a strap affixed at one end to the fabric opposite the flap. The strap is places through the ring opening and then the strap is threaded through a slit formed in the open end of the flap. The strap is then secured to the fabric.

Figure 1A:
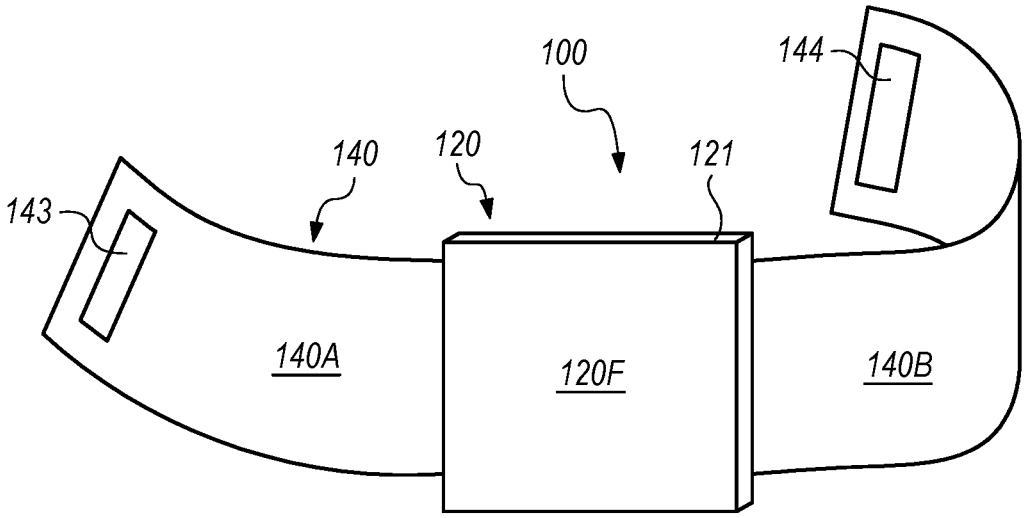
FIG. 1A is a front perspective view illustrating a first embodiment of a temporary ring storage apparatus.
Figure 1B:
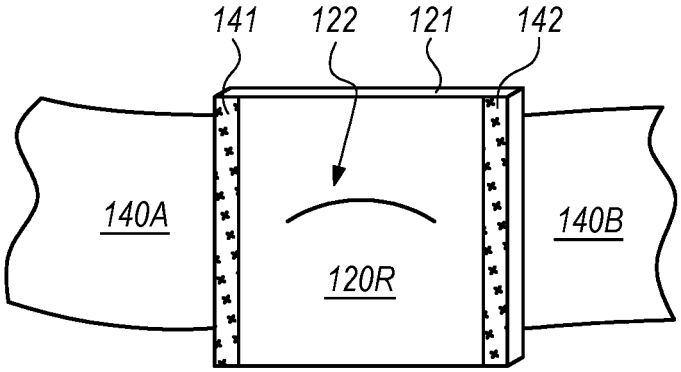
FIG. 1B is a rear perspective view of the temporary ring storage apparatus.

FIGS. 1A and 1B illustrate a first ring storage apparatus 100, which consists of two main components, namely, a small pouch 120 coupled with a flat strap 140. Both the pouch 120 and the strap 140 can be made from any type of natural or synthetic fabric or blend thereof, such as cotton, nylon and polyester. The pouch 120 can be produced in a variety of different shapes, including square, rectangular, circular, semi-circular, crescent, star, and so on. The pouch 120 can be coupled with the strap 140 in many ways, some of which are described here.

In this first embodiment, the pouch 120 is a flat, two-ply fabric having a front panel 120F and a rear panel 120R that define a closed interior portion 121 of the pouch. The closed interior portion 121 is no more than the nominal space between the abutting front and rear panels 120F, 120R, which are attached to each other at their edges to form the closed structure as further described below. Further, a small slit 122 is provided in the rear panel 120R of the pouch 120 for inserting the selected jewelry item(s) into the pouch. As one example, the square pouch 120 could be 2½ inches square, with a slit 122 approximately 1 inch long, although many different dimensions are possible to achieve the best combination of comfort and security.

The material and/or weave of the pouch 120 should be selected to provide a secure interior space 121 from which the jewelry cannot readily fall out or be pushed through the material. For example, propylene anti-static tubing is a synthetic formed sleeve that is used for packing and shipping electronic circuit boards, which is commercially available in 500 foot rolls of 2 inch wide sleeve having a 4 mil total thickness (0.004 inches). This material is strong and lightweight and may be cut into 2 inch lengths, which leaves the ends open and the top and bottom closed. The strap 140 could be split into half parts 140A, 140B, each of which can then be attached one of the open ends of the sleeve, for example, with sewn seams 141, 142, to thereby close the ends and seal up the interior portion 121 (except for the slit of course). Other materials, techniques and dimensions could be employed to provide similar results.

In use, the user first inserts his or her ring or other jewelry item(s) into the pouch 120 through the slit 122 in the rear panel 120R. The pouch 120 is then held with the rear panel 120R against a selected body part, most typically the arm, but possibly the neck or waist, and the strap 140 is wrapped around the body part and fastened (more on fastening below).

Figure 1C:
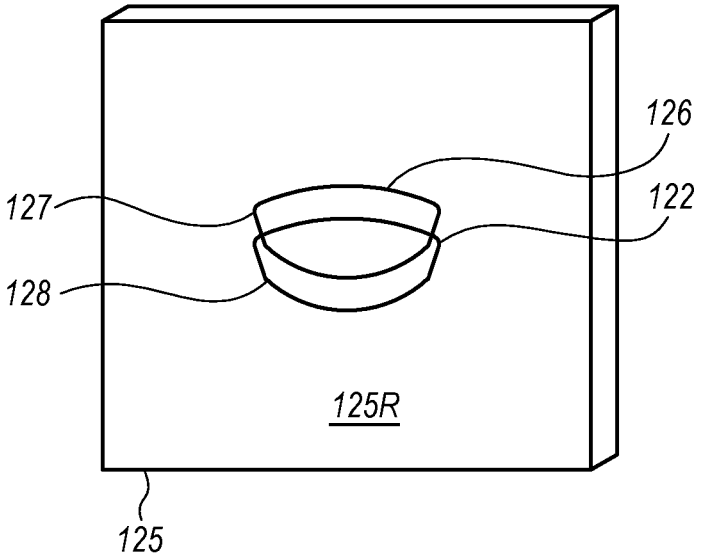
FIG. 1C is a rear perspective view illustrating an alternative embodiment of a temporary ring storage apparatus.

A number of alternatives could be incorporated into the ring storage apparatus illustrated in FIGS. 1A-1B. For example, in FIG. 1C, the rear panel 125R of an alternative pouch 125 includes the slit 122, but also a flap 126 is affixed or formed over the slit. In this example, the flap 126 has a crescent moon-shape and simply covers the slit 122 to add an extra layer of material to secure the jewelry item(s) inside the pouch 125. Optionally, the flap 126 may include a fastener portion 127 with a corresponding mating fastener portion 128 secured to the rear panel 125R, in order to further secure the flap 126 against the pouch. The fasteners 126, 127 may be hook and loop style fasteners, or adhesive strips, or any other equivalent and simple closure mechanisms.

Figure 1D:
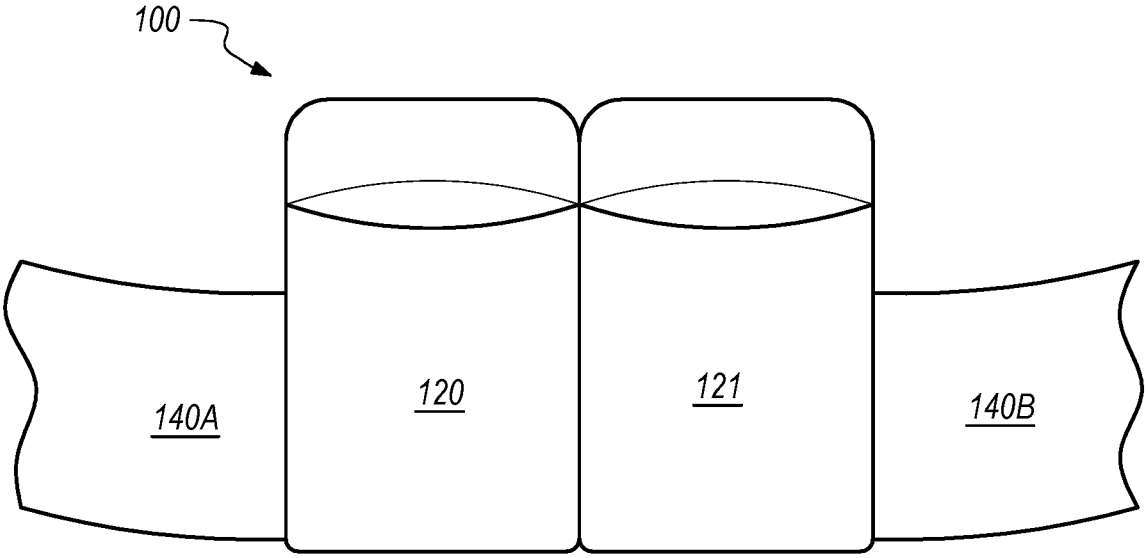
FIG. 1*d* is a rear perspective view illustrating another alternative embodiment of a temporary ring storage apparatus having two storage pouches secured between strap portions.

As another example, FIG. 1D illustrates a ring storage apparatus 101 that is similar to ring storage apparatus 100, but this embodiment includes two pouches 120, 121 coupled between the strap portions 140A, 140B. The pouches 120, 121 are constructed in the same manner as previously described.

The strap 140 has a length that can vary depending upon whether the strap 120 is made to wrap around the user's arm, neck, waist, etc., and a width that is not critical but will be relatively narrow, for example, ½ inch to 2 inches.

The strap 140 can be made from a lightweight natural or synthetic fabric or blend thereof, such as cotton, nylon, polyester, propylene, or similar materials. In one arrangement, the strap 140 has two parts, with one part 140A fastened to the left side of the pouch 120, for example, by seam 141 sewn onto the rear portion 120F of the pouch, and the other part 140B similarly fastened to the right side on the rear portion of the pouch by sewn seam 142.

Each strap part 140A, 140B preferably includes one of the mating fastener parts 143, 144 affixed at the distal end of each strap part. For example, the fasteners 143, 144 may be hook and loop fasteners, buttons or snaps, or similar mechanical fasters. Hook and loop fasteners may be preferred since they can be provided with some length to allow for adjustment of the strap length when wrapping and securing the strap.

In one embodiment, the straps parts 140A, 140B may have narrowed ends so that the straps parts may be simply tied off or knotted in position on the user. Alternatively, cords could be affixed to grommets near the end of each strap part, and the cords tied off or knotted to secure the strap.

As another alternative to hook and loop fasteners, the ends of each strap part could be fitted with any type of closure mechanism, such as a buckles, D-rings, buttons, snaps, latches, tabs, or other similar well-known closures.

Figure 2A:
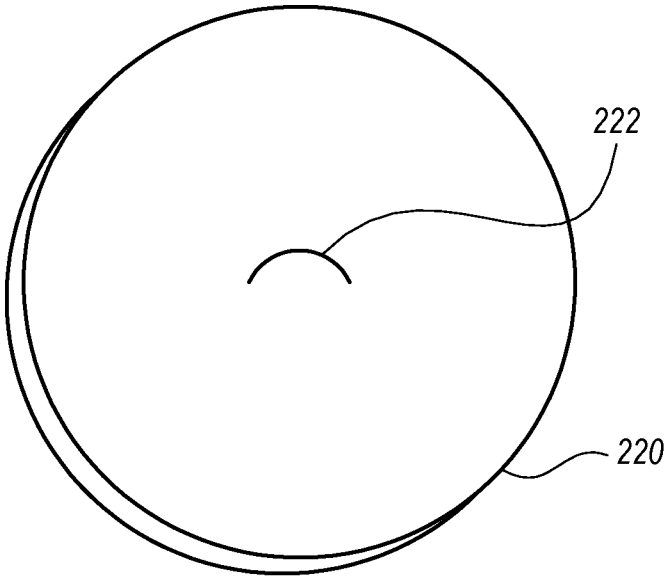
FIG. 2A is a perspective view illustrating another alternative embodiment of a temporary ring storage apparatus.
Figure 2B:
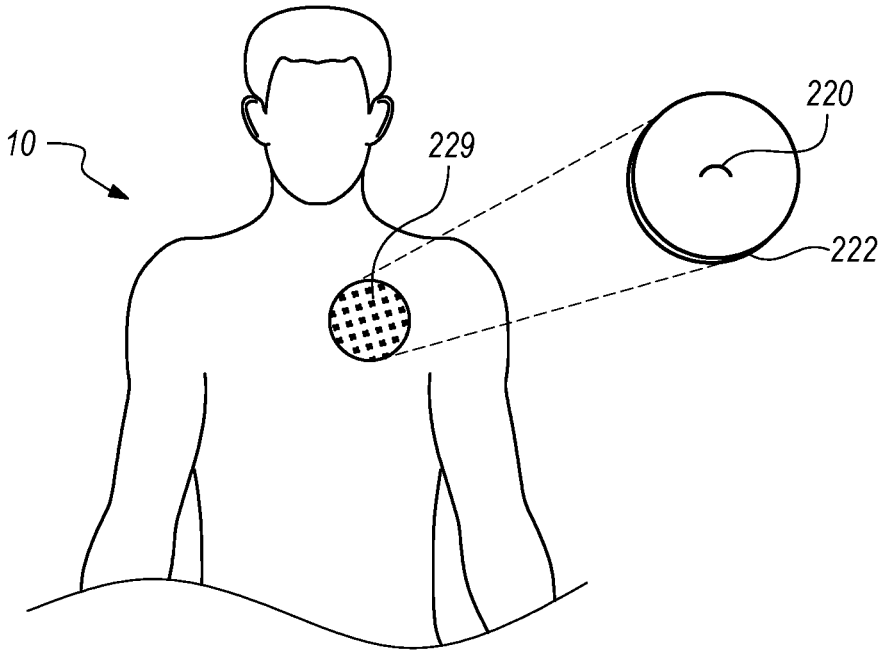
FIG. 2B is a perspective view illustrating placement of the ring storage apparatus of FIG. 2A on the user's body.

Referring now to FIGS. 2A and 2B, the back side of a circular pouch 220 is illustrated, including slit 222. The structure and material of the pouch 220 is as previously described. In this embodiment, however, the user 10 applies an adhesive gel 229 to a part of their body, like the arm or chest, and places the back side of the pouch 220 against the body part with adhesive gel so that the pouch is retained against the body part by the gel. Alternatively, the adhesive gel may be incorporated with the pouch. For example, the adhesive gel 229 can be a conductive gel of the type used by health care professionals to attach EKG electrodes to the body, which is effective at holding the pouch 220 in place but water soluble and easy to clean up afterward. For example, grounding pads for electrosurgery made by Bovie Medical Corp. include a super adhesive hydrogel for secure patient application of the pads. The adhesive gel 229 can be liberally applied over an area of 2-3 inches to provide an adequate area for contacting with the pouch 220.

Figure 3A:
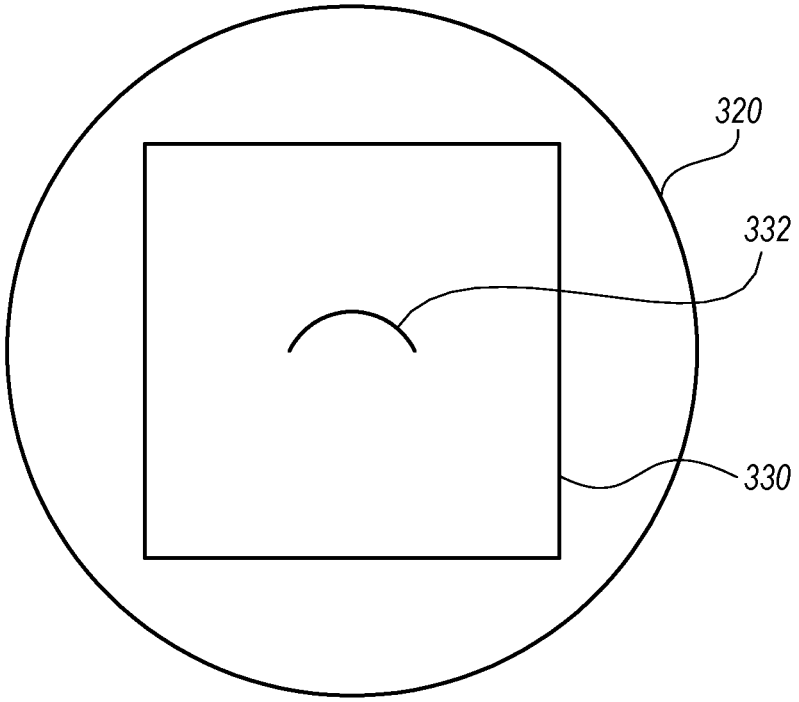
FIG. 3A is a plan view showing a ring storage apparatus having a peel-away strip.
Figure 3B:
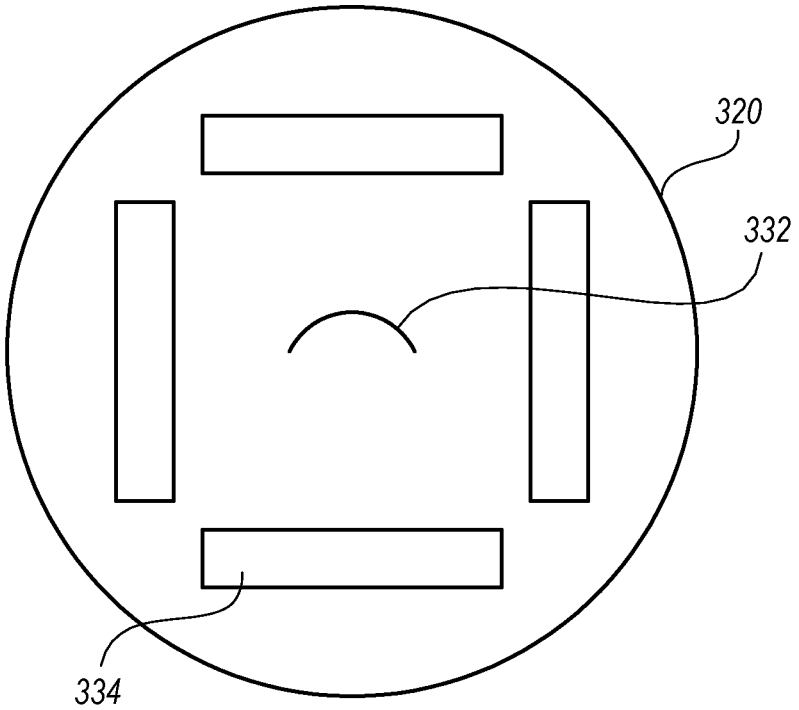
FIG. 3B shows the ring storage apparatus with peel-away strip removed.

FIGS. 3A and 3B illustrate an alternative pouch 320 having adhesive elements 334 that are affixed to the back side of the pouch. A peel-away strip 330 covers the adhesive elements 334. In use, the peel-away strip is removed to expose the adhesive elements, then the pouch 320 is placed onto a selected body part where the adhesive elements hold the pouch against the body part. The adhesive elements 334 may be an adhesive tape, for example, of which there are many cohesive and latex-free adhesive or surgical tapes made for the medical industry. The peel-away strip 330 is a thin piece of plastic fabric, for example, as used with adhesive bandages such as Band-Aid® brand bandages.

Cohesive tape is a product that sticks only to itself, and may be utilized with any of the pouch embodiments described herein to secure a pouch to a body part by placing the pouch, then wrapping cohesive tape around the body part to cover the pouch, most typically, somewhere along the arm.

FIG. 4 illustrates an alternative embodiment in which a narrow strap 440, e.g., approximately ½ inch wide felt fabric, is threaded through a ring 401 and then wrapped back around the ring in order to hold the ring tight. The strap 440 can then be wrapped around the user's upper arm and its ends knotted together to securely hold to ring in place. Alternatively, hook and loop fasteners 443, 444 can be affixed to the ends of the strap 440 and used to fasten the strap once it is wrapped around the user's arm.

FIG. 5 illustrates another pouch 520 that includes slit 522. However, secured within the pouch 520 is a length of string 523. The string 523 may be used to tie to the ring and thereby retain the ring more securely within the pouch 520.

Figure 6A:
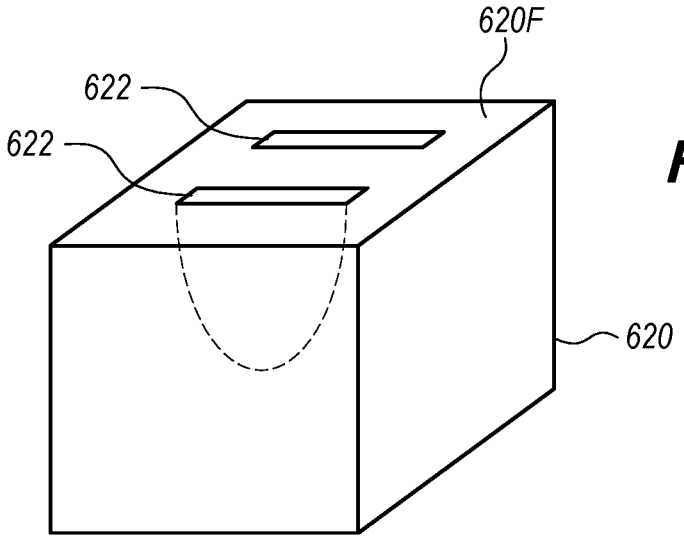
FIG. 6A is an alternative embodiment of a temporary ring storage apparatus.

FIG. 6A illustrates yet another storage apparatus 620. In this embodiment, the pouch apparatus 620 is a small rectangular or square three-dimensional piece of packaging foam, for example, with a size no more than 2-3 inches in each dimension. Two slits 622 are cut into the face portion 620F and down into the foam pouch 620 for receiving two rings, although more than two slits could be provided. Once the rings are placed into the slits 622, the face portion 620F is held against a body part, such as the arm, and wrapped with adhesive or cohesive tape. Alternatively, a strap could be configured to secure the foam pouch 622 by either tying the strap off, or having closures affixed to the ends of the strap, such as hook and loop fasteners, as previously described.

Figure 6B:
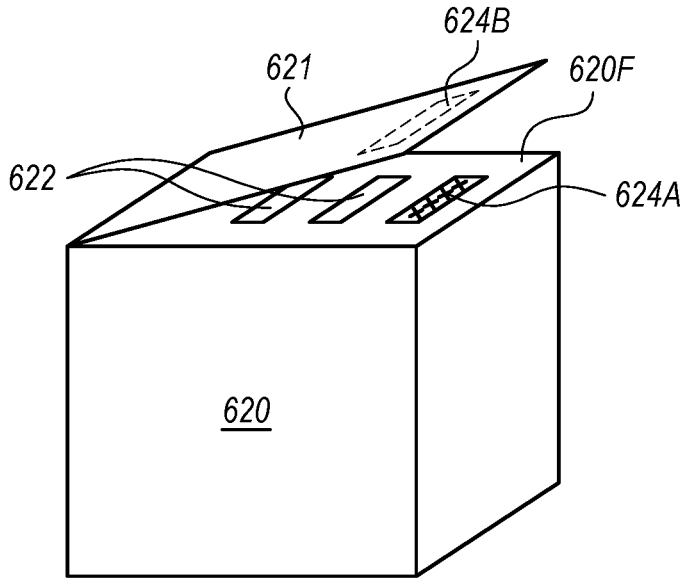
FIGS. 6B and 6C illustrate variations to the embodiment of FIG. 6*a*.

In another variation, illustrated in FIG. 6B, the foam pouch 620 could be configured with a cover 621 that is affixed to one side of the top surface 620F of the pouch. The attachment of the cover 621 to the foam pouch 620 could be a sewn seam (not shown), or alternatively, the foam pouch could be sliced part way through such that one side remains affixed as part of the foam pouch (i.e., like a hinge) and the other side is free to be lifted or lowered. Further, the foam pouch 620 and the cover 621 may have mating fastening elements 624A and 624B affixed thereto, respectively, such as hook and loop fasteners, although other types of fasteners could also be used. Therefore, additional security is provided when the ring(s) is inserted into a recess 623 of the pouch 620 below the slit 622, and the cover 621 is closed and fastened.

Figure 6C:
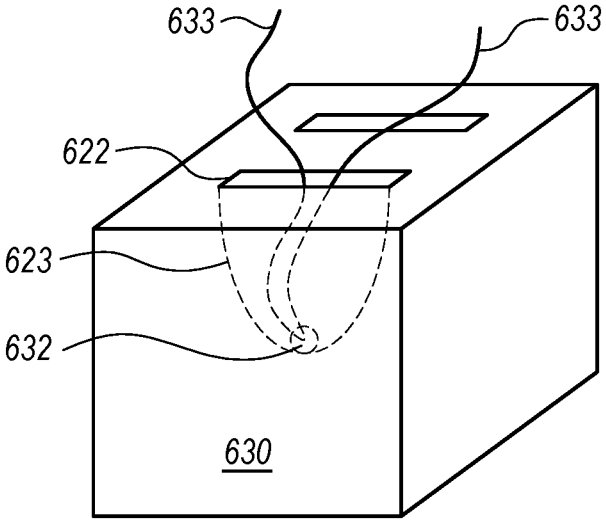

In yet another variation, illustrated in FIG. 6C, the foam pouch 630 includes an anchor element 632 affixed at the bottom of the recess 623, and a strap or string 633 affixed to the anchor element. The string 633 can be used to tie off a ring when it is inserted into the pouch 630 in order to more securely hold the ring in place within the pouch.

Figure 7A:
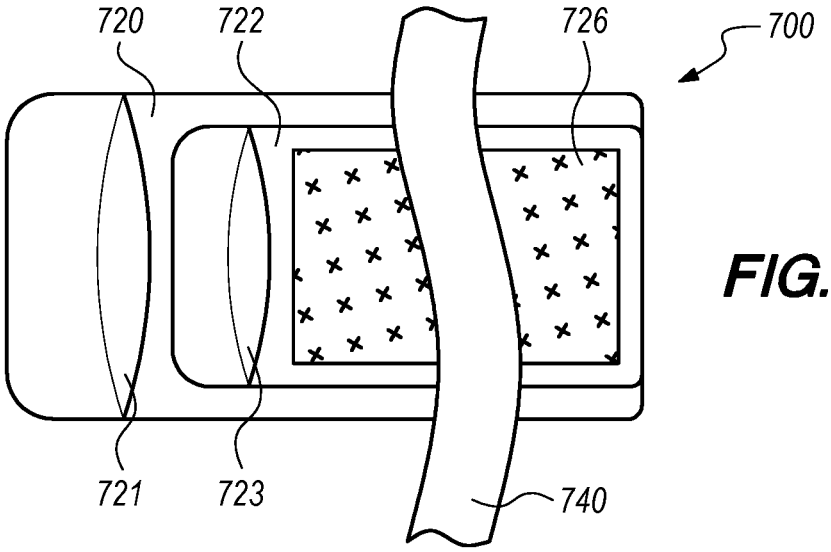
FIGS. 7A and 7B illustrate another alternative embodiment of a temporary ring storage apparatus.
Figure 7B:
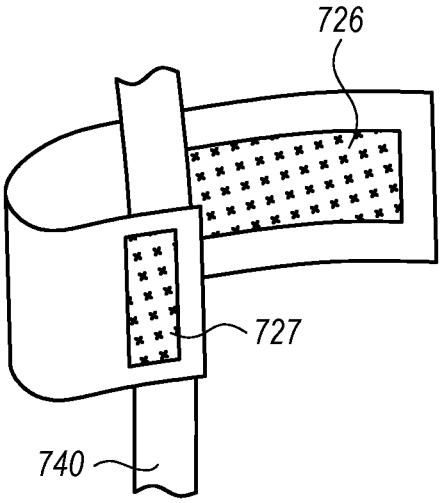

FIGS. 7A and 7B illustrate another alternative ring storage apparatus 700. In this embodiment, the ring storage apparatus 700 includes a first pouch 720 having a slit opening 721 and a second pouch 722 having a slit opening 723. The apparatus 720 could also be configured with only a single pouch (not shown) or more than two pouches (not shown). A fastener element 726 is attached to the inside portion of the second pouch 722 and a mating fastener element 727 is attached to the outside portion of the second pouch. In use, the rings are inserted into respective pouches, then the apparatus 700 is wrapped around a strap 740, such as a bra strap, belt loop, belt, etc., of the user, and fastened to itself by the fastening elements 726, 727.

Figure 7C:
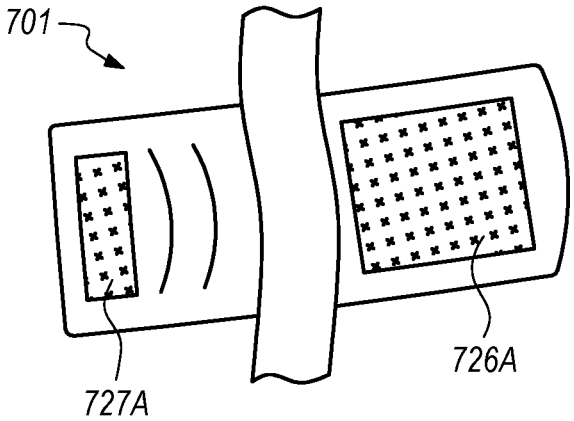
FIG. 7C illustrates a variation to the embodiment of FIG. 7A.

FIG. 7C illustrates an alternative ring storage apparatus 701 wherein the fastener elements 726*a*, 727*a* are located on the same side of the apparatus.

Figure 8A:
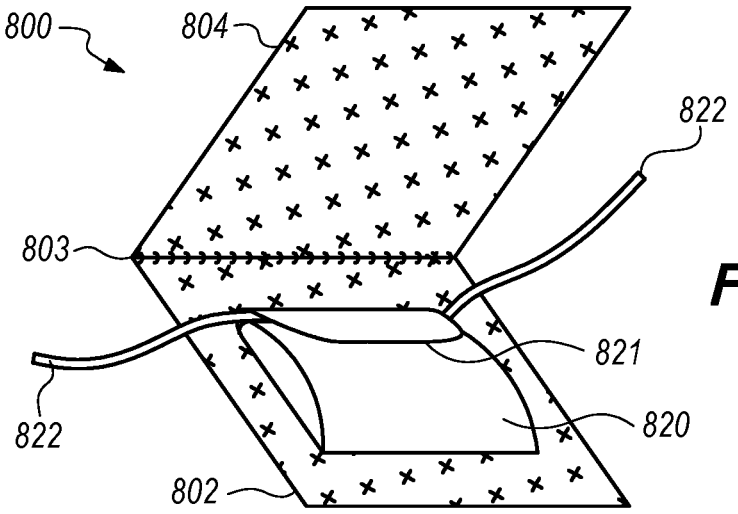
FIGS. 8A and 8B illustrate another alternative embodiment of a temporary ring storage apparatus.

Yet another embodiment of a ring storage apparatus 800 is illustrated in FIG. 8A. Ring storage apparatus 800 includes a pouch 820 attached in the center of a first fastener sheet 802. The first fastener sheet 802 is attached along one edge to a second fastener sheet 804, for example, by a sewn seam 803 that acts as a "hinge" to allow the fastener sheets to be opened and closed with each other. The fastener sheets 802, 804 are preferably mating hook and loop fasteners such that fastener sheet 804 can be securely fastened to fastener sheet 802 by simply pressing the two pieces together. Since the pouch 820 is centered, the fastener sheets 802, 804 seal together on all four sides surrounding the pouch.

The pouch 820 may be made from a thicker, more plush material in this embodiment, to provide better protection for larger rings, i.e., rings with gems in settings that protrude from the circular base. As in prior embodiments, the pouch 820 can include a slit 821 or flap so that a ring can be inserted within the pouch. Further, the pouch 820 may include a string 822 that is affixed with the pouch near the slit 821 so that the user can tie off the ring to provide additional security. Thus, the user would open the fastener sheets 802, 804 to expose the pouch 820, insert the ring into the pouch and tie it off using string 822, then close the fastener sheets on themselves to seal the pouch within.

Since the fastener sheets 802, 804 seal to each other when closed together, they could likewise close over a strap, such as a bra strap.

Figure 8B:
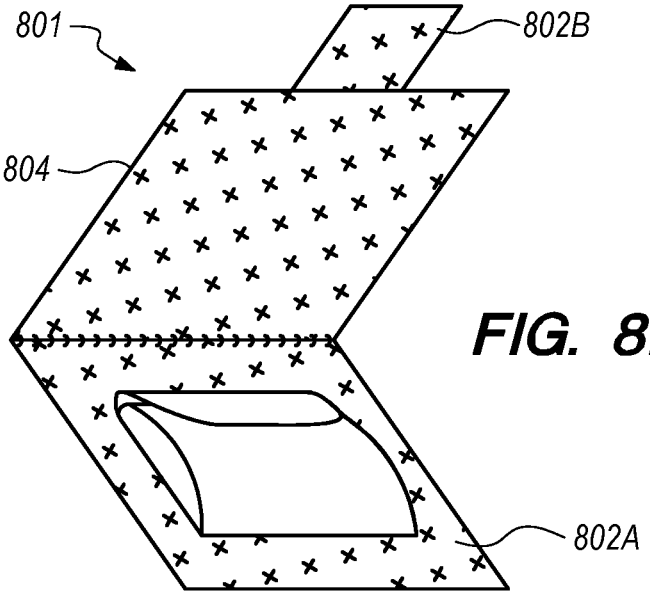
Figure 8C:
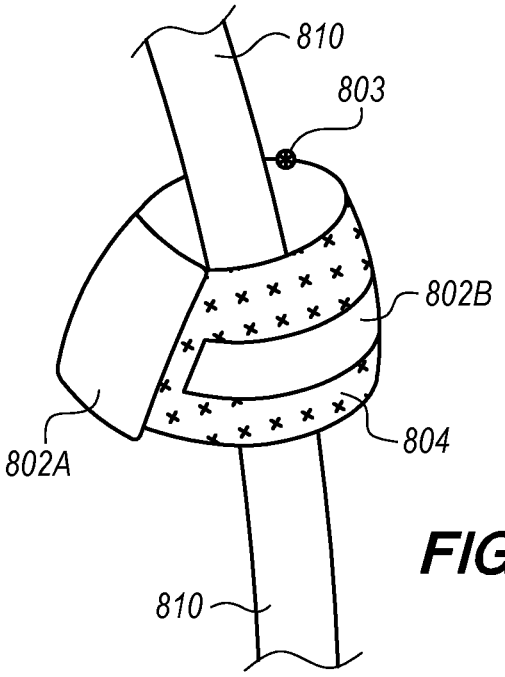
FIG. 8C illustrates a variation to the embodiment of FIG. 8A.

Referring to FIGS. 8B and 8C, a similar ring storage apparatus 801 includes a fastener tab 802*b* that has the same configuration as fastener sheet 802*a*, that is, it is configured to mate with fastener sheet 804. Thus, the ring storage apparatus can be wrapped around a strap 810, such as a bra strap or belt, and in addition to fastener sheets 802*a*, 804 sealing together, the tab 802*b* can be also be secured to the outside of fastener sheet 804 for additional security.

Figure 9A:
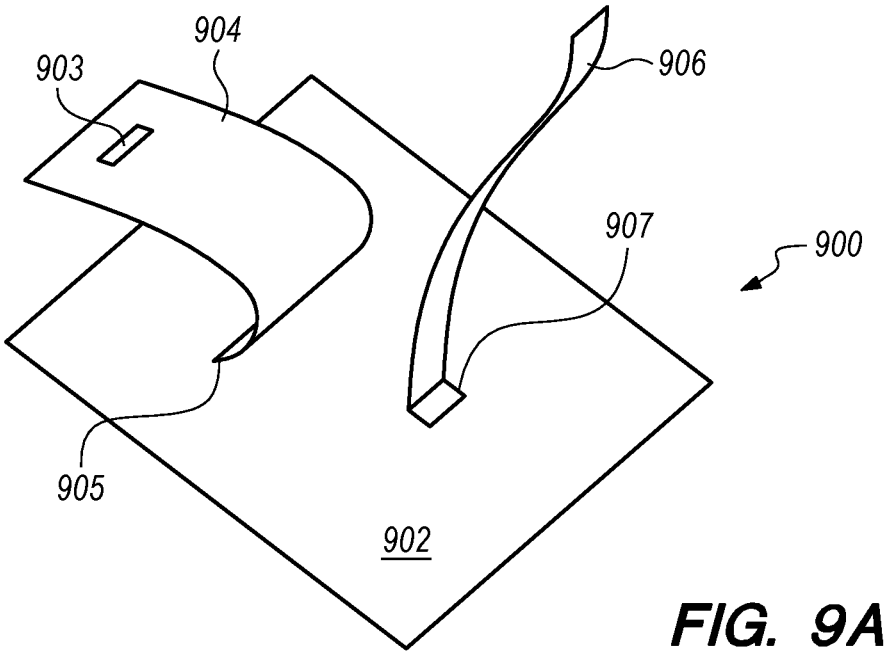
FIG. 9A is a perspective view of an alternative embodiment of a temporary ring storage apparatus.
Figure 9B:
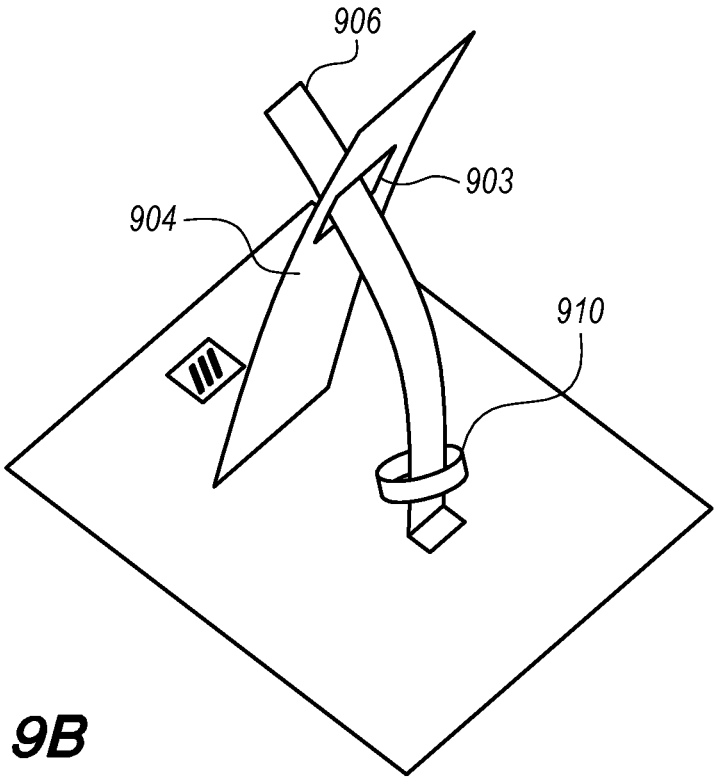
FIGS. 9B and 9C are perspective views illustrating use of the apparatus.
Figure 9C:
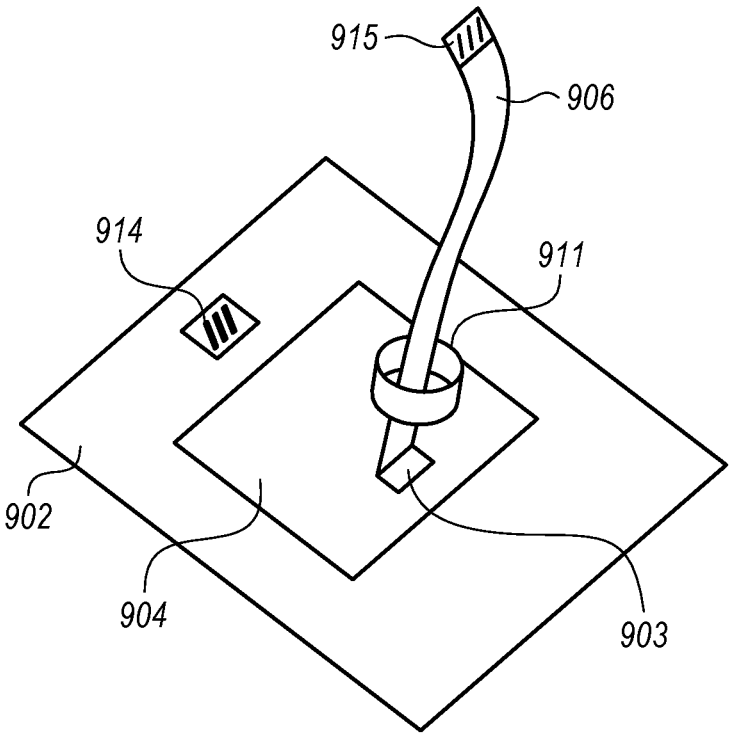

FIGS. 9A-9D illustrate another embodiment of a ring storage apparatus 900. The apparatus 900 includes a small square or rectangular fabric patch 902 having a fabric flap 904 affixed at one end thereof to the patch, for example, by sewn seam 905, and a ribbon 906 affixed at one end thereof to the patch, for example, by sewn seam 907. The flap 904 includes a slit 903 into which the ribbon 906 will be inserted, as further described below. The flap 904 is affixed at a first location on the patch 902 that is approximately ⅓ of the distance across the patch, and the ribbon 906 is affixed at a second location on the patch that is approximately ⅔ of the distance across the patch, In FIG. 9B, a first ring 910 has been slipped over the ribbon 906, and the free edge of the ribbon is inserted through the slit 903 in patch 904. Advantageously, the free edge of the ribbon 906 may have a pointed tip to facilitate insertion through the slit. The flap 904 is then laid flat over the first ring. In FIG. 9C, a second ring 911 is slipped over the ribbon 906. The ribbon 906 is then fastened to the patch 902. For example, the patch 902 and the ribbon 906 may each be fitted with mating fasteners 914, 915, such as hook and loop fasteners.

Figure 9D:
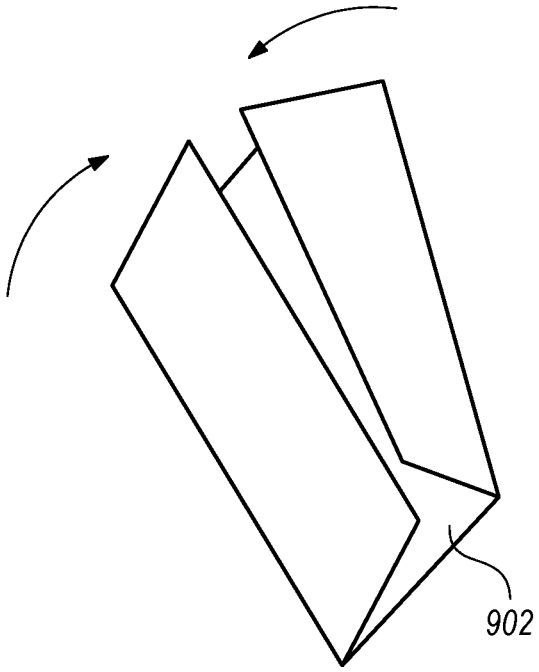
FIG. 9D is a perspective view illustrating folding of the apparatus of FIG. 9A.

The patch 902 is then folded over in thirds to cover the rings 910, 911 and flap 904, as shown in FIG. 9D. The patch may then be held against the body, for example, the upper arm, and secured to the body using cohesive tape. Alternatively, the back of the patch 902 could be fitted with a non-latex adhesive tape, or a double-sided adhesive tape, with a peel-away strip (not shown). Another alternative provides mating fasteners, such as hook and loop fasteners, on portions of the patch such that the patch can be secured to itself when folded.

Figure 10A:
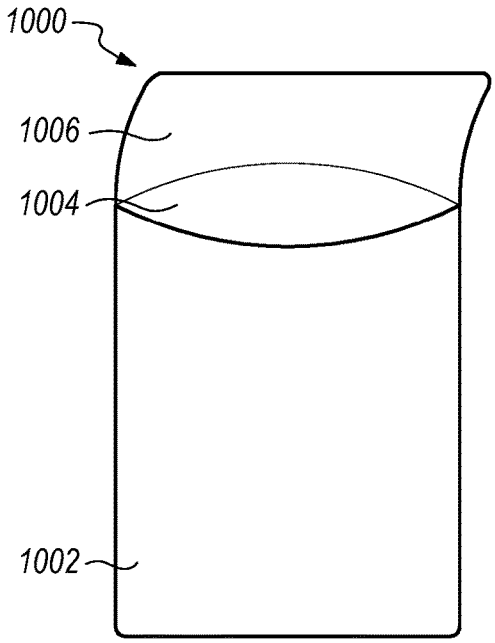
FIG. 10A is a front plan view of an alternative embodiment of a temporary ring storage apparatus.
Figure 10B:
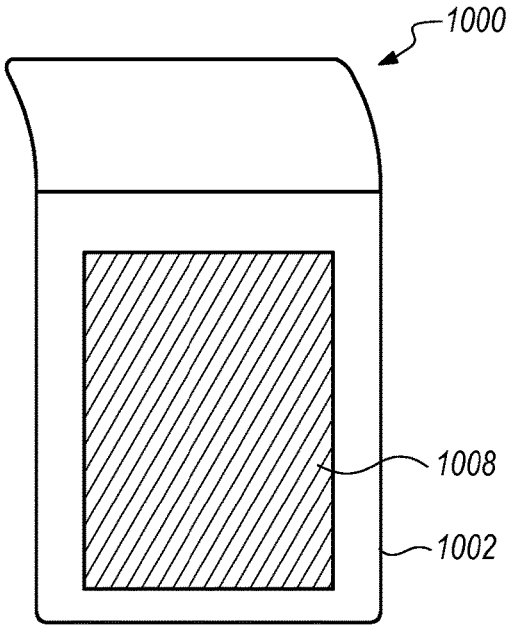
FIG. 10B is a rear plan view thereof.

Referring to FIGS. 10A and 10B, another ring storage apparatus 1000 is illustrated. FIG. 10A shows the front view and FIG. 10B the rear view. The apparatus 1000 is a simple plastic pouch 1002 having an opening 1004 at one end and a flap 1006 configured to cover the opening. For example, the pouch 1002 may be a 1.5 mil plastic poly bag measuring 2 inches by 3 inches. In one embodiment, the back side of the pouch includes non-latex adhesive tape 1008 for securing the pouch to the person. In another embodiment, the flap 1006 and the pouch 1002 have mating fastener elements to help securely close the opening once a ring is placed inside.

Figure 11:
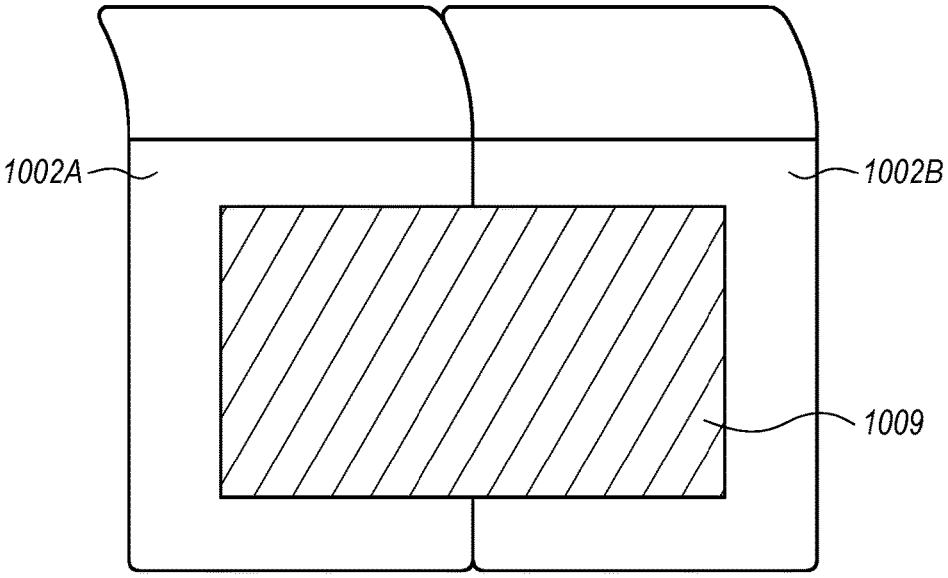
FIG. 11 is a rear plan view of two apparatuses of FIG. 10A coupled together.

FIG. 11 illustrates an alternative configuration wherein the backside of two pouches 1002A, 1002B are coupled together with a double-sided, non-latex adhesive tape 1009. A peel-away strip exposes the outside portion for securing the pouch to the person.

Figure 12A:
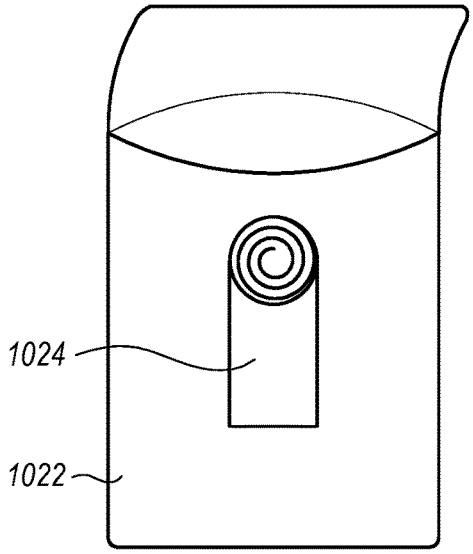
FIGS. 12A and 12B are front plan views of an alternative embodiment of a temporary ring storage apparatus.
Figure 12B:
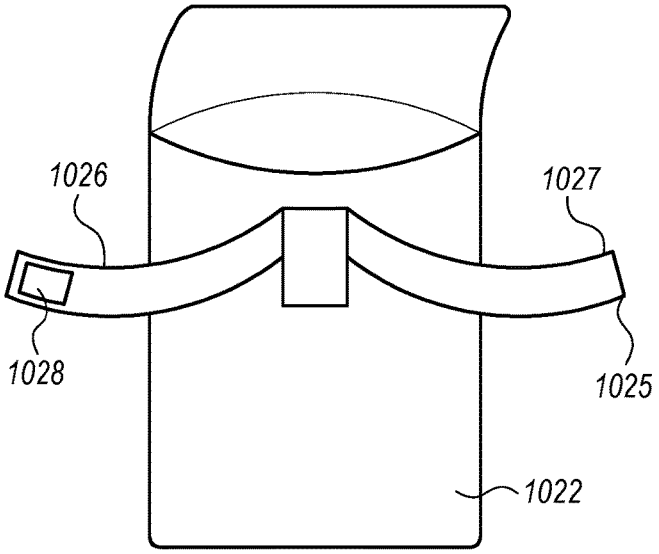

FIG. 12A shows another alternative embodiment, wherein a rolled up strap or ribbon 1024 is affixed to pouch 1022. In FIG. 12B, with a ring placed inside the pouch, the strap 1024 is unrolled, with one portion 1025 wrapped around the pouch in one direction and another portion 1027 wrapped around the pouch in the other direction. The straps 1025, 1027 could be tied together, or alternatively, mating fasteners 1027, 1028 could be used on each strap, such as hook and loop fasteners, such that the strap ends are secured to each other.

While various embodiments have been described herein, it should be understood that they have been presented by way of example only, and not limitation. For example, the embodiments described above illustrate various features that may be combined in a number of different ways to achieve both storage of a ring within the pouch and securing the pouch to the person. The storage apparatus may be a thin fabric pouch that defines an interior volume for storage of the ring, or the apparatus may be made from a thicker, plusher fabric to provide better protection for larger rings and ring features. The apparatus may also be a three-dimensional square or rectangular foam pouch that can secure multiple rings or larger rings. The apparatus may be a simple flat patch of fabric having a strap to hold one or more rings, and a flap with a slit so that the strap may be threaded through the slit to pull the flap over the ring and then secure the strap to the flat fabric patch. The apparatus may be secured to itself, or folded over a strap and secured to itself, using fastening elements like hook and loop fasteners (such as Velcro® fasteners), or adhesive strips. The apparatus may be secured to a person using an adhesive gel.

I claim:

1. An apparatus, comprising:

a single flat piece of fabric;

a single flap affixed at a proximal end thereof to a first portion of the fabric and otherwise unaffixed, the flap having a slit near a distal end the flap; and a single strap affixed at a proximal end thereof to a second portion of the fabric separated from the first portion and otherwise unaffixed, wherein a first valuable item can be slipped over a distal end of the strap, the distal end of the strap can be inserted through the slit in the flap, the distal end of the strap can be secured, and the fabric can be folded over itself.

2. The apparatus of claim 1, further comprising:

a first fastener affixed to the fabric; and a second fastener affixed to the strap, wherein the distal end of the strap is secured by coupling the second fastener with the first fastener.

3. The apparatus of claim 1, further comprising a cohesive tape securing the folded fabric.

4. The apparatus of claim 1, wherein a second valuable item is slipped over the strap after the distal end of the strap is inserted through the slit in the flap and before the distal end of the strap is secured.

5. The apparatus of claim 1, further comprising:

a pair of mating fasteners each affixed on corresponding portions of the fabric in order to secure the apparatus when the fabric is folded over itself.

6. The apparatus of claim 1, wherein the strap has a narrowed end to facilitate insertion into the slit in the flap.

* * * * *